US009696038B2

(12) United States Patent
Braden et al.

(10) Patent No.: US 9,696,038 B2
(45) **Date of Patent: *Jul. 4, 2017**

(54) HOME APPLIANCE WITH SUPPLEMENTAL COMBUSTION AIR SUPPLY APPARATUS

(71) Applicants: BSH Home Appliances Corporation, Irvine, CA (US); BSH Hausgeräte GmbH, Munich (DE)

(72) Inventors: Ben Braden, Lafollett, TN (US); Charlie Hanna, Knoxville, TN (US); Richard Moyers, Morristown, TN (US); Timothy Russell, Jacksboro, TN (US)

(73) Assignees: BSH Home Appliances Corporation, Irvine, CA (US); BSH Hausgeräte GmbH, Munich (DE)

( * ) Notice: Subject to any disclaimer, the term of this patent is extended or adjusted under 35 U.S.C. 154(b) by 344 days.

This patent is subject to a terminal disclaimer.

(21) Appl. No.: 14/315,824

(22) Filed: Jun. 26, 2014

(65) Prior Publication Data

US 2014/0305424 A1 Oct. 16, 2014

Related U.S. Application Data

(63) Continuation-in-part of application No. 13/711,711, filed on Dec. 12, 2012, now Pat. No. 9,341,381.

(51) Int. Cl.
*F24C 3/00* (2006.01)
*F24C 3/08* (2006.01)
(Continued)

(52) U.S. Cl.
CPC ..... *F24C 3/085* (2013.01); *F23D 14/34* (2013.01); *F23D 14/64* (2013.01); *F23L 5/02* (2013.01); *F23N 3/002* (2013.01); *F23N 3/007* (2013.01)

(58) Field of Classification Search
CPC ..... F24C 3/085; F24C 3/087; F24C 15/006; F23L 5/02; F23N 3/002; F23N 3/007;
(Continued)

(56) References Cited

U.S. PATENT DOCUMENTS 7,766,005 B2 8/2010 Lee et al.
7,836,877 B2 11/2010 Gagas et al.
(Continued)

FOREIGN PATENT DOCUMENTS

EP 2072901 A1 6/2009
EP 2527665 A2 11/2012
(Continued)

OTHER PUBLICATIONS

European Search Report EP 15 16 9866 dated Oct. 7, 2015.

*Primary Examiner* — Alfred Basichas
(74) *Attorney, Agent, or Firm* — Michael E. Tschupp; Andre Pallapies

(57) ABSTRACT

A home appliance with a cooktop and an oven cavity. A gas-operable burner for heating the cavity to a cooking temperature and including a gas mixing pipe is mounted to the appliance with a bracket and has an inlet for intake of gas and air for combustion, the gas mixing pipe being mounted to the appliance with a bracket. A ventilation channel extends through the appliance body. A fan is in fluid communication with the ventilation channel for creating an airstream within the ventilation channel. An air conduit extends between the ventilation channel and the gas mixing pipe, with an air conduit inlet in the airstream and an air conduit outlet adjacent the gas mixing pipe to direct air from the airstream to the gas mixing pipe for combustion with the gas and air. An air conduit stabilization apparatus mounts the air conduit to the gas mixing pipe bracket.

20 Claims, 9 Drawing Sheets

(51) Int. Cl.

| | |
|---|---|
| ***F23L 5/02*** | (2006.01) |
| ***F23N 3/00*** | (2006.01) |
| ***F23D 14/34*** | (2006.01) |
| ***F23D 14/64*** | (2006.01) |

(58) Field of Classification Search
CPC .. F23N 2033/06; F23N 2041/08; F23D 14/34; F23D 14/64; F23D 14/105
See application file for complete search history.

(56) References Cited

U.S. PATENT DOCUMENTS

| | | | | |
|---|---|---|---|---|
| 9,341,381 | B2 * | 5/2016 | Braden | F24C 3/087 |
| 2007/0044786 | A1 | 3/2007 | Frost et al. | |
| 2014/0158110 | A1 | 6/2014 | Braden et al. | |

FOREIGN PATENT DOCUMENTS

| | | | |
|---|---|---|---|
| JP | 2008185252 | A | 8/2008 |
| WO | 0173326 | A1 | 10/2001 |

* cited by examiner

HOME APPLIANCE WITH SUPPLEMENTAL COMBUSTION AIR SUPPLY APPARATUS

CROSS-REFERENCE TO RELATED APPLICATION

This application is a continuation-in-part of U.S. patent application Ser. No. 13/711,711, filed Dec. 12, 2012.

BACKGROUND OF THE INVENTION

The present invention relates broadly to home appliances for cooking and, more particularly, to a gas range having a supplemental primary air supply and stabilization apparatus.

Gas ranges provide an excellent baking and broiling environment for preparing various dishes in a highly effective manner. Gas ovens burn hot and steady and provide excellent temperature control as well as an instant on-and-off operation with little residual heat. For oven heating, gas ovens include bake elements and broil elements similar to their electric counterparts, but with different structures based on the need to supply the gas heating elements with a combustible fuel and air mixture and the ability to produce discrete flames for even oven-cavity heating.

Gas broiler elements are used when the oven is to be taken to an elevated temperature for broil-type cooking and due to the location of the broil element near the top of the oven cavity, the space between the oven cavity and an associated cooktop can reach undesirable temperatures. Therefore, in order to provide better control of the cooktop temperature as well as protect the electronics of nearby control systems, gas ovens can include a ventilation channel that can provide a cooling airstream intermediate the oven cavity and the cooktop. Usually such a ventilation channel includes a ventilation fan for forced-air ventilation of the channel intermediate the cooktop and the oven cavity. It should be noted that while there may be other fans, such as convection fans and the like, associated with a gas range, the only fan of concern to the present invention is the ventilation fan and references herein to "the fan" refer to the ventilation fan.

The gas burner is fueled by a mixture of gas injected by a gas nozzle and ambient air from behind the oven cavity. The air-to-gas ratio is controlled generally to provide the most efficient burning situation while providing the necessary energy input to elevate the oven to cooking temperatures, or in the case of pyrolytic cleaning, to cleaning temperatures that are substantially greater then cooking temperatures.

During times of elevated or high temperatures within the oven cavity and when the fan is in operation, the fan intake tends to draw primary air away from the broil burner intake and the burning efficiency of the broil burner is reduced due to air deficiency. It therefore becomes desirable to enhance the efficiency of the gas broil burner by providing more primary air to the broil burner intake during such periods of air deficiency.

SUMMARY OF THE INVENTION

It is accordingly an object of the present invention to provide a home appliance, such as a gas range, with enhanced broil burner efficiency without adding undue expense to the overall cost and production complexity of the gas range, and to provide enhanced burning efficiency in an economic manner that utilizes existing structure where available.

It is another object of the present invention to provide such a home appliance with supplemental primary air for enhanced burning efficiency during high-temperature operations.

It is another object of the present invention to provide such a home appliance with a supplemental primary air delivery apparatus that is stable and acts to locate the supplemental primary air delivery for efficient operation.

It is another object of the invention to provide such a home appliance that will restrict movement and warping of air delivery components undergoing heating during high temperature operations.

To those ends, a home appliance with a supplemental primary air supply includes an appliance body, a cooktop on the appliance body and an oven cavity within the appliance body. A gas-operable heating element is within the oven cavity for heating the oven cavity to a predetermined temperature, with the heating element including a gas mixing pipe, or venturi, having an inlet open for intake of gas and primary air for combustion wherein the gas mixing pipe is configured for drawing primary combustion air from inside the appliance body, thereby creating a first primary airstream. A gas supply pipe is included for delivering gas to the gas mixing pipe for mixing with the first primary airstream, the gas supply pipe being mounted to a pipe support member for locating and aiming the gas pipe with respect to the gas mixing pipe.

A ventilation channel extends through the appliance body intermediate the cooktop and the oven cavity and is configured to draw air for ventilation from outside the appliance. A ventilation fan is located within the appliance body, with the fan being in fluid communication with the ventilation channel for creating an airstream within the ventilation channel, wherein the fan is selectively operable for use during times of elevated temperature within the oven cavity.

A supplemental primary air delivery apparatus is included for use during ventilation fan operation to create a second primary airstream and includes an air conduit extending between the ventilation channel and the gas mixing pipe, with the air conduit having an air conduit inlet in the ventilation airstream and an air conduit outlet closely adjacent the gas mixing pipe to direct air from the ventilation airstream to the gas mixing pipe as the second primary airstream for mixing with the first primary airstream and gas to form a combustible gas-air mixture. The present invention also includes an air conduit stabilization apparatus.

Preferably the air conduit stabilization apparatus includes a first bracket mounted to the air delivery conduit adjacent the ventilation fan, the first bracket being upstanding from a support surface and including a curved portion for engaging and stabilizing the air conduit. The first bracket is preferably configured to restrict movement of the air conduit undergoing heating.

It is preferred that the air conduit stabilization apparatus includes a second bracket mounted to the air conduit adjacent the gas mixing pipe and engaged with the gas mixing pipe bracket. Preferably, the second bracket includes a curved portion for engaging the gas mixing pipe and a downwardly projecting engagement member for engaging the gas mixing pipe. It is further preferred that the second bracket includes two downwardly projecting engagement members for engaging the gas mixing pipe bracket.

Preferably, the second bracket supports the gas mixing pipe at a position away from the center of the gas mixing pipe inlet adjacent a gas supply nozzle at the inlet of the gas mixing pipe. It is preferable that the second bracket is configured to restrict movement of the air conduit undergoing heating.

Preferentially, the air conduit stabilization apparatus includes a first bracket mounted to the air delivery conduit adjacent the ventilation fan, the first bracket being upstanding from a support surface and including a curved portion for engaging and restricting movement of the air conduit in a first direction and a second bracket wherein the air conduit stabilization apparatus includes a second bracket mounted to the air conduit adjacent the gas mixing pipe and engaged with the gas mixing pipe bracket for restricting movement of the air conduit in a second direction, wherein the second direction is different than the first direction.

It is preferable that the home appliance is a range.

The air conduit stabilization apparatus of the present invention provides several advantages. First, the first and second brackets can ensure that the air conduit is consistently correctly installed across a production run of the present home appliances. Accordingly, more uniform performance characteristics are achieved across the production run. Further, the second bracket provides a precise location for the air outlet with respect to the burner venturi to maximize efficiency of the air conduit system. The first and second brackets also resist any tendency of the air conduit to warp or otherwise distort while undergoing heating during high temperature operations. Imprecise positioning, distortion or both of the air tube can prevent the present apparatus from operating at its best efficiency. The incoming secondary air stream could have a detrimental effect on the gas stream if positioned incorrectly in one direction or disrupt air flow at the venturi walls if moved in the other direction. If the air conduit is too far away from the venturi, the airstream from the air conduit may be disrupted or otherwise rendered ineffective. Accordingly, it is desirable to precisely position the air conduit with respect to burner venturi.

The present invention also includes a second preferred embodiment, which is also preferably a range. To that end, the present home appliance includes a home appliance body, a cooktop on the home appliance body, an oven cavity within the home appliance body and a gas-operable heating element within the oven cavity for heating the oven cavity to a predetermined temperature, wherein the heating element includes a gas mixing pipe having an inlet open for intake of gas and primary air for combustion.

A ventilation channel extends through the home appliance body intermediate the cooktop and the oven cavity. A ventilation fan is located within the home appliance body, the fan being in fluid communication with the ventilation channel for creating an airstream within the ventilation channel.

An air conduit extends between the ventilation channel and the gas mixing pipe, the air conduit having an air conduit inlet in the airstream and an air conduit outlet closely adjacent the gas mixing pipe to direct air from the airstream to the gas mixing pipe as supplemental primary air for combustion with the gas and primary air.

Preferably, the fan is mounted within a fan housing having an air outlet into the ventilation channel and the air conduit is mounted with the air conduit inlet in the air outlet of the fan housing. It is further preferred that the air conduit is formed as a tubular member having an air channel extending between the air conduit inlet and the air conduit outlet for free air passage through the air conduit. Preferably, the air conduit inlet includes a flared end portion. It is preferred that the air channel has a generally circular cross-section and a substantially constant diameter throughout its length and that the air conduit outlet is mounted adjacent a gas supply nozzle at the inlet of the gas mixing pipe.

Preferentially, the fan is configured to activate at a predetermined temperature to provide air to the ventilation channel and the air conduit, and, more particularly, the fan is configured to activate at a temperature in the home appliance of about 300° F. to about 350° F.

It is further preferred that the fan includes an inlet for drawing air from outside the home appliance for forced delivery of air to the ventilation channel and the air conduit.

DESCRIPTION OF THE PREFERRED EMBODIMENT

Figure 1:
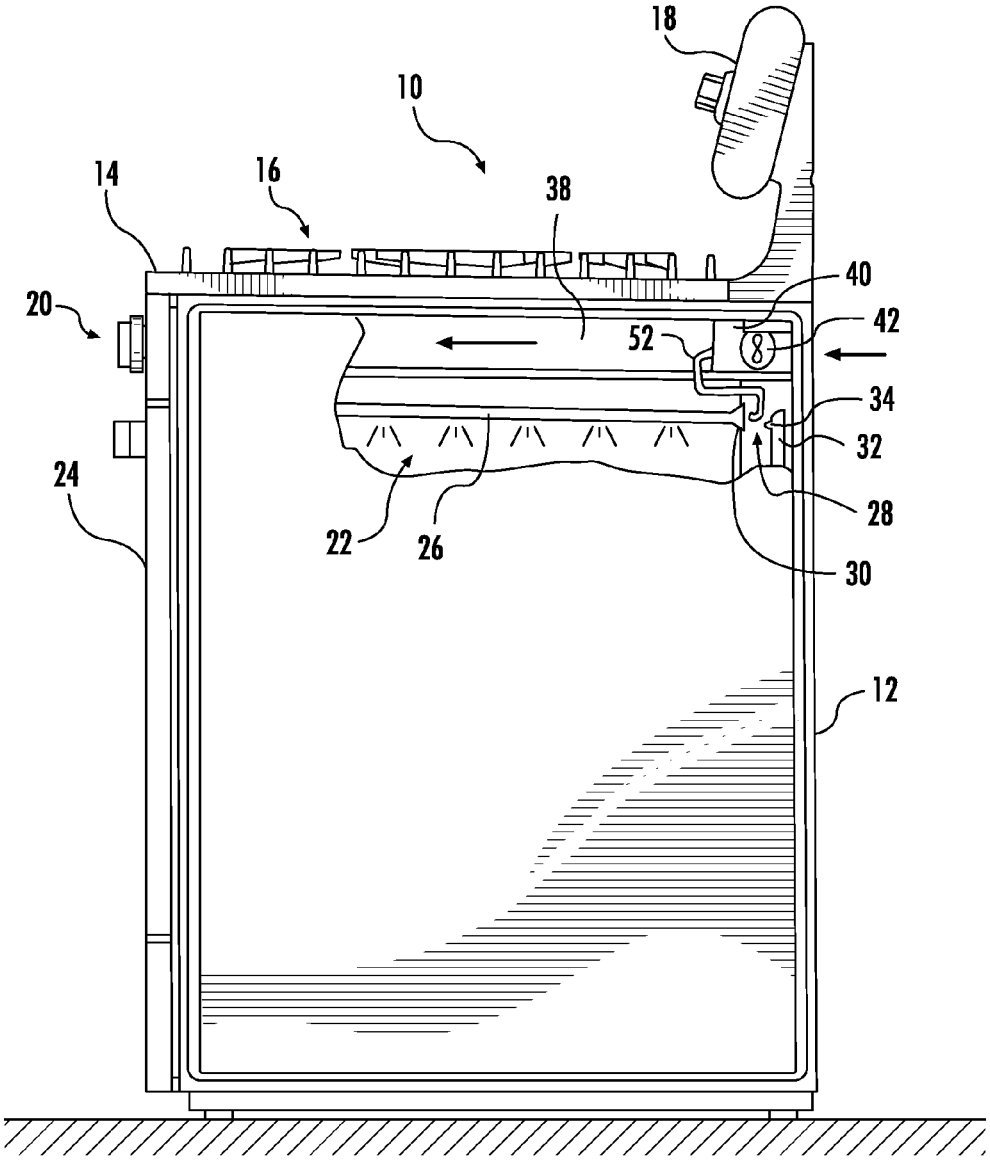
FIG. 1 is a side diagrammatic view of a gas range broken open to illustrate the broil burner with an air conduit according to the present invention.

Turning now to the drawings and, more particularly to FIG. 1, a range having a supplemental primary air supply for a broil element, according to the preferred embodiment of the present invention, is illustrated generally at 10 and includes a generally rectangular floor standing body 12 that includes an internal framework covered by external body panels. A cooktop 14 is located on the top portion of the body 12 and includes a number of burners having grates 16 for supporting cooking vessels.

An upper control panel 18 is mounted behind and above the cooktop 14 for general disposition against a kitchen wall. The upper control panel 18 may include oven controls and a timer. A lower control panel 20 is mounted to the front of the body 12 immediately underneath the cooktop 14. The lower control panel 20 may include controls for the burners on the cooktop 14. The body 12 includes an internal oven cavity 22 with an access opening covered by an oven door 24 that is mounted to the body 12 immediately beneath the lower control panel 20.

FIG. 1 is broken open to diagrammatically illustrate the internal components of the present invention. The oven cavity 22 includes one or more bake burners at the lower portion of the oven cavity (not shown) and one or more broil burners 26 at the upper portion of the oven cavity 22. A gas mixing pipe 28 forming a venturi extends from the rear of the oven cavity and is in fluid communication with the broil burner 26 to receive air and gas for combustion. The gas mixing pipe 28 includes a flared inlet 30. The inlet 30 of the gas mixing pipe 28 is outside the oven cavity and ambient air is drawn from around a rear portion of the range 10 for mixing with gas from the nozzle 34.

A gas supply pipe 32 extends from a main gas supply through a distribution network (not shown) and, for purposes of the broil burner 26, includes a gas nozzle 34 to direct gas into the gas mixing pipe 28. Ambient air is drawn in with the gas from the nozzle 34 as primary air for combustion in the broil burner 26 to produce flame in order to elevate the temperature within the oven cavity 22 to cooking or cleaning levels.

As the temperature in the oven cavity 22 increases to a predetermined level, typically, between 300° F. and 350° F., the heat from the top of the oven can cause problems with the cooktop 14 and the electric and electronic controls of the range. Therefore, an air channel 38 is located intermediate the oven cavity 22 and the cooktop 14. In order to more effectively cool the air between the cooktop 14 and the oven cavity 22, a fan 42 is mounted within a fan housing 40 adjacent a rear portion of the range 10 within the ventilation channel 38 to draw ambient air from outside the range 10 and direct such air through the ventilation channel 38 to cool the area between the cooktop 14 and the oven cavity 22. The airstream thusly created is illustrated generally by arrows in FIG. 1.

According to a preferred embodiment of the present invention, an air supply conduit in the form of a tube is illustrated at 52 and extends from the fan housing 40, where it receives air, to the gas delivery pipe 32 where the air is discharged into the gas mixing pipe 28 to provide supplemental primary air, along with the gas from the gas nozzle 34 and the existing ambient primary air for combustion.

Figure 2:
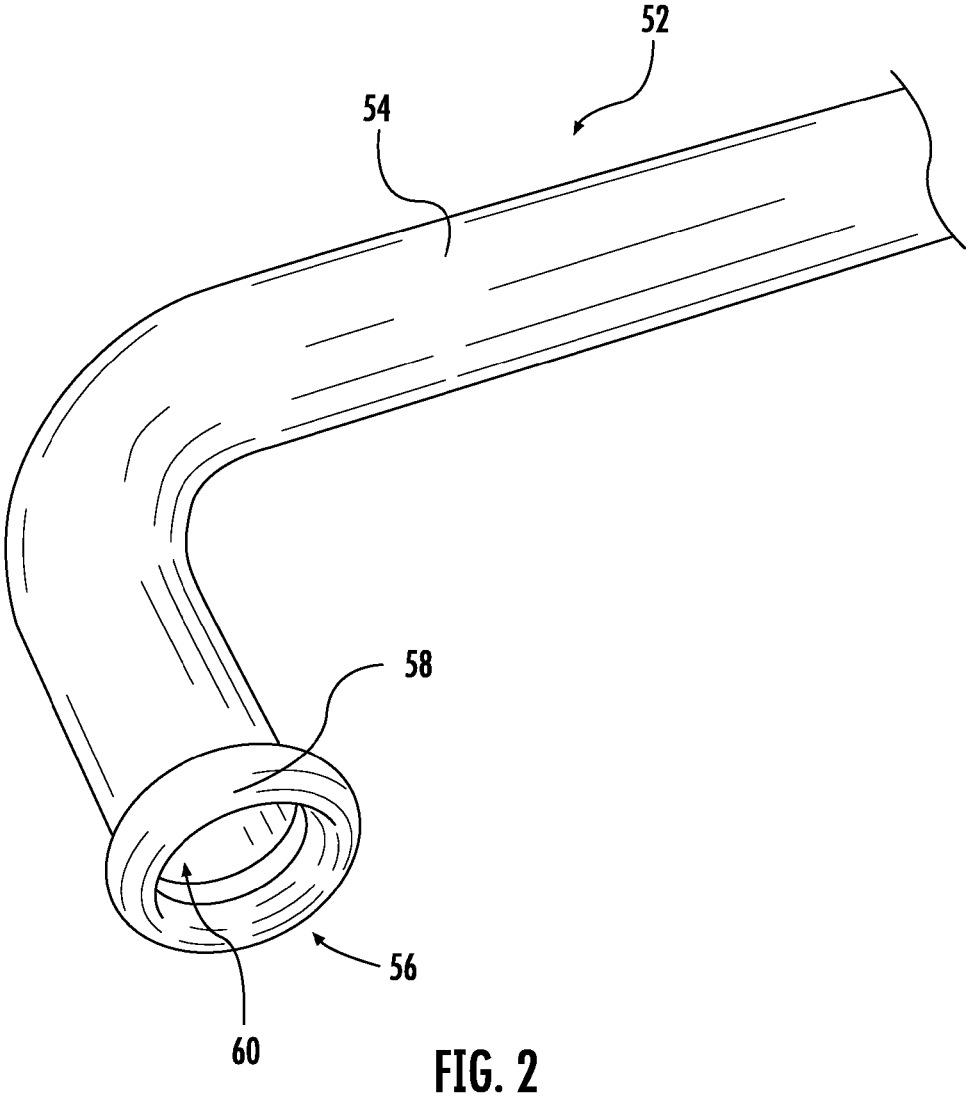
FIG. 2 is a partial view of the air conduit, illustrating the inlet, of the apparatus illustrated in FIG. 1.

As seen in FIG. 2, the air conduit 52 includes a generally tubular body 54 wherein the interior of the tubular body 54 defines an air channel 60. The tubular body 54 includes an inlet 56 to the air channel 60 with a flared end portion 58 for improved air intake.

Figure 3:
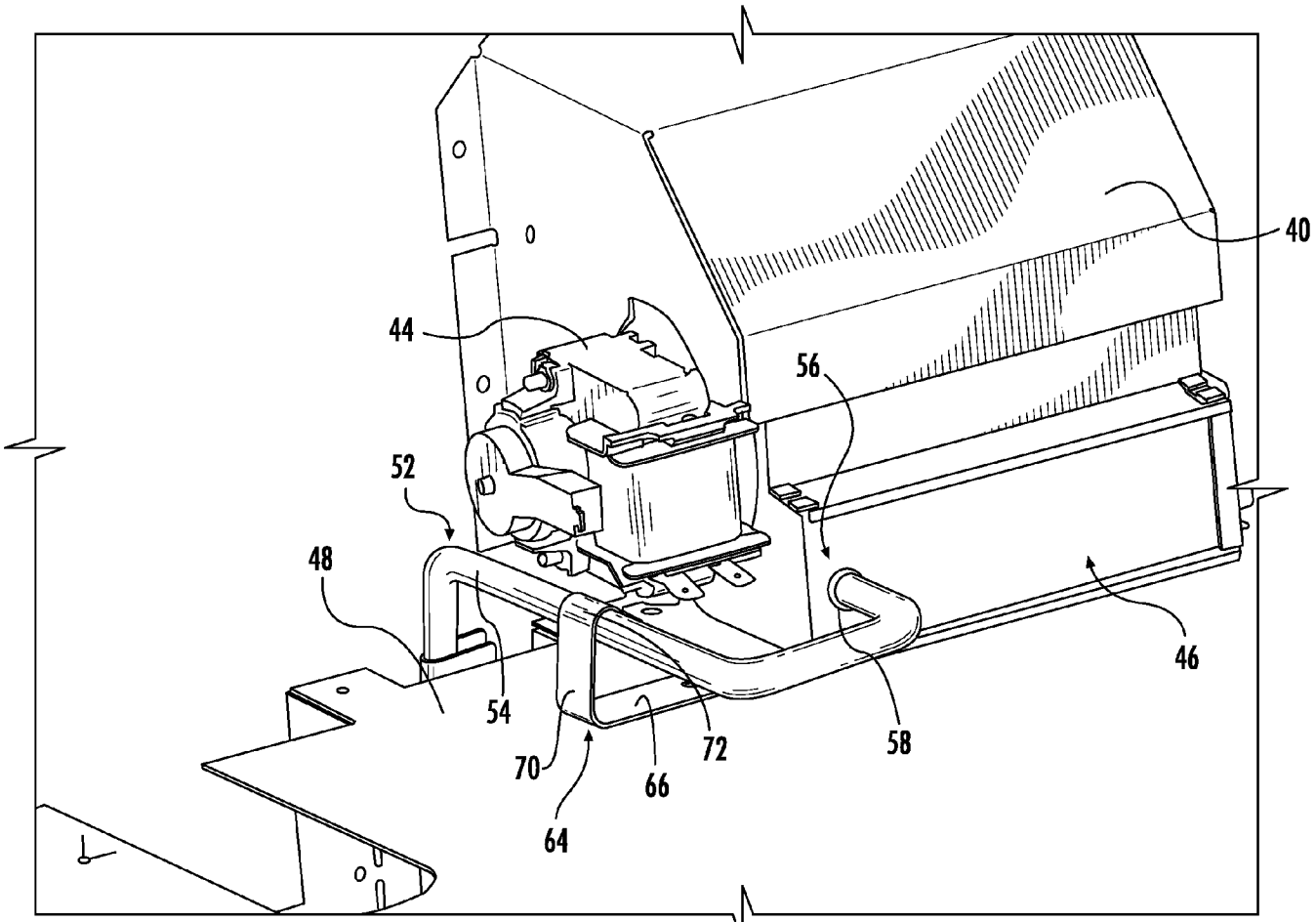
FIG. 3 is a front perspective view of the fan assembly and air conduit within the present home appliance according to one preferred embodiment of the present invention.
Figure 7:
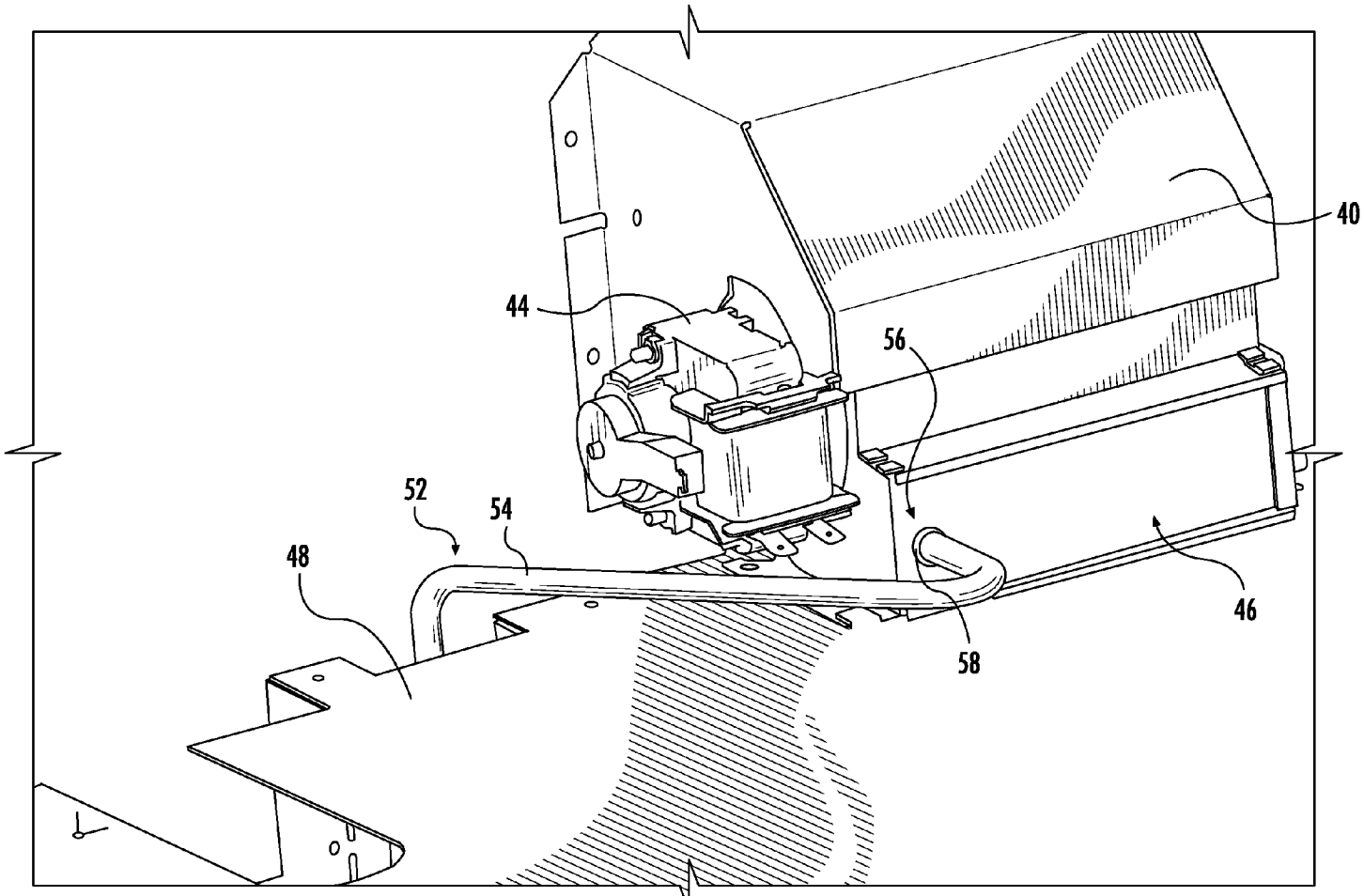
FIG. 7 is a front perspective view of the fan assembly and air conduit within the present home appliance according to another preferred embodiment of the present invention.

Turning now to FIG. 3 and FIG. 7, the air conduit 52 is illustrated in relation to the fan housing 40 for directing air into the air conduit 52. There, the fan housing 40 is illustrated as a generally box-like structure having a fan motor 44 mounted on one side thereof, and which is in turn mounted to a horizontal support panel 48 within the range body 12. The fan blades (not shown) are of the centrifugal fan or squirrel cage fan type and are internal to the housing 40. The fan rotor extends the full width of the housing 40 and directs air into a plenum 46. It will be understood by those skilled in the art that the plenum 46 empties into the ventilation channel as illustrated in FIG. 1 which is not shown in FIG. 3 for clarity.

The air conduit 52 is mounted with its inlet 56 directed into the plenum 46 of the fan housing 40 to receive air from the fan. As noted above, the flared end portion 58 enhances the ability of the air conduit 52 to receive air. The air conduit 52 is bent to direct the air away from the fan housing 40 across the horizontal support panel 48 and downwardly toward the broil burner 26.

Figure 4:
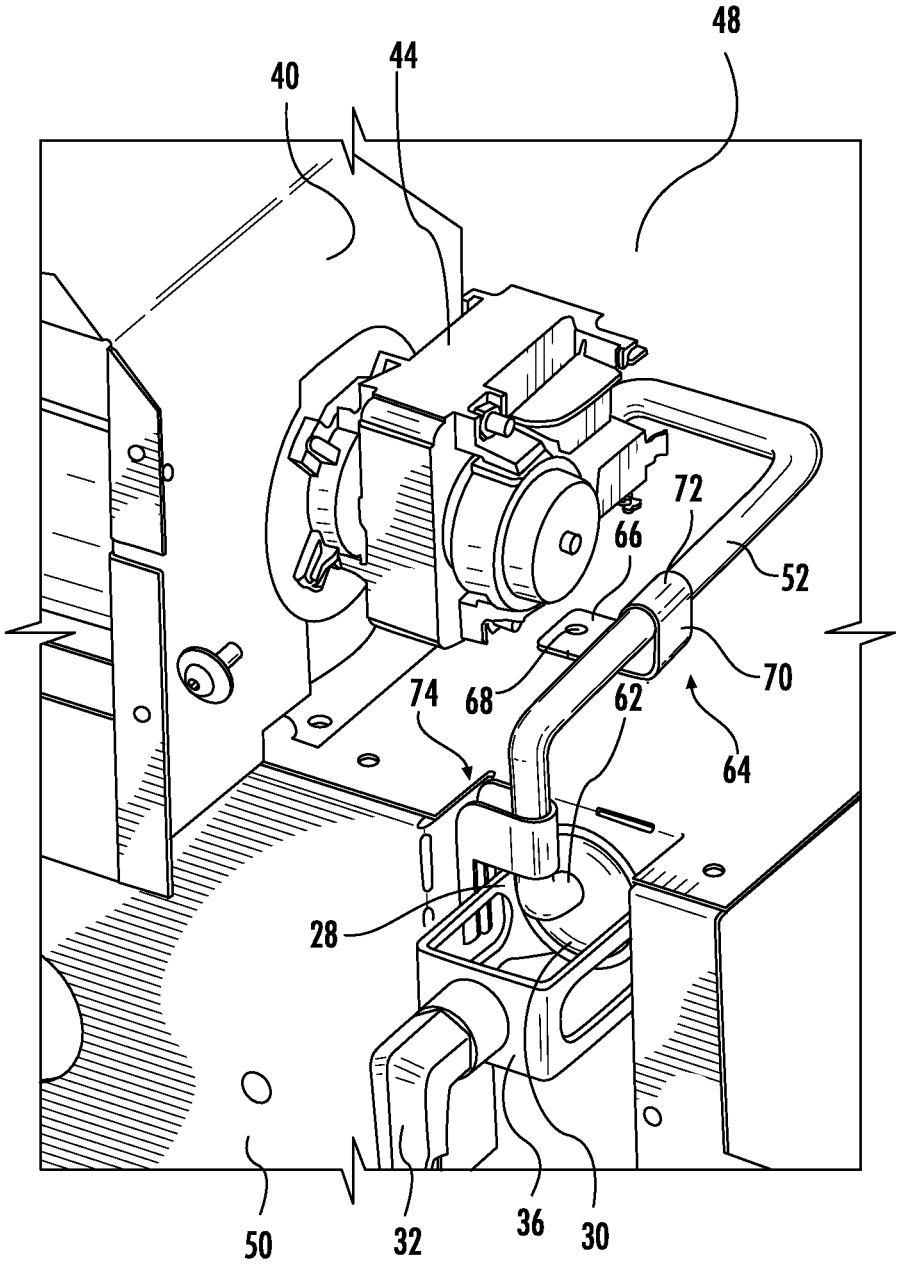
FIG. 4 is a rear view of the fan assembly and air conduit illustrated in FIG. 3.

As seen in FIG. 3 and FIG. 4, the air conduit 52 is supported by an air conduit stabilization apparatus which supports, stabilizes and positions the air conduit for maximum efficiency and enhanced durability in light of the heat encountered in the air conduit area. The air conduit stabilization apparatus includes a first bracket 64 mounted to the horizontal support panel 48. The first bracket 64 is formed from a single metal strip and includes a base portion 66 mounted to the horizontal support panel 48 curving into a generally upstanding support member 70 extending to the conduit 52. A hole 68 is formed in the base portion to facilitate mounting. A curved portion 72 extending from the upstanding support member wraps over and engages the air conduit 52 to define engagement surfaces on both the air conduit 52 and the first bracket 64. The first bracket 64 not only positions the air conduit, but restricts movement and warping of the air conduit 52 in a first direction under heating.

Figure 5:
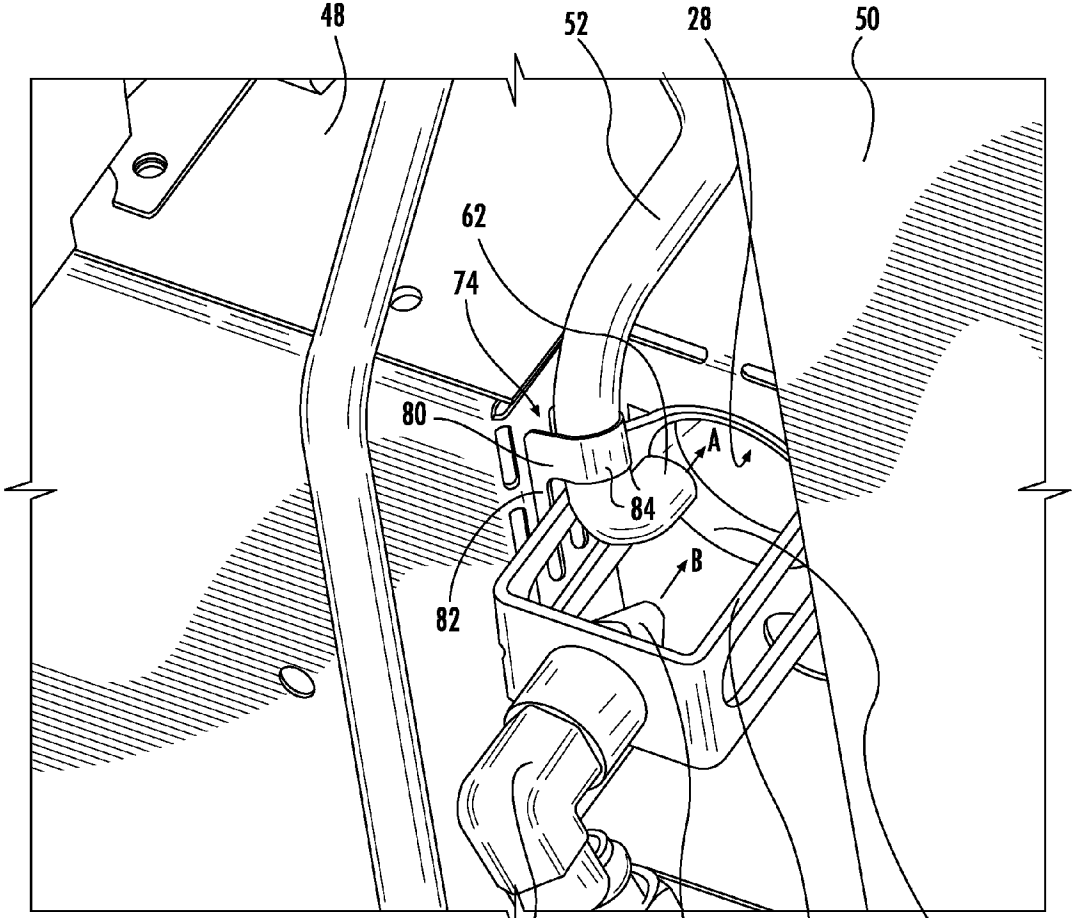
FIG. 5 is a perspective view of the gas and air delivery system illustrated in FIG. 4.
Figure 6:
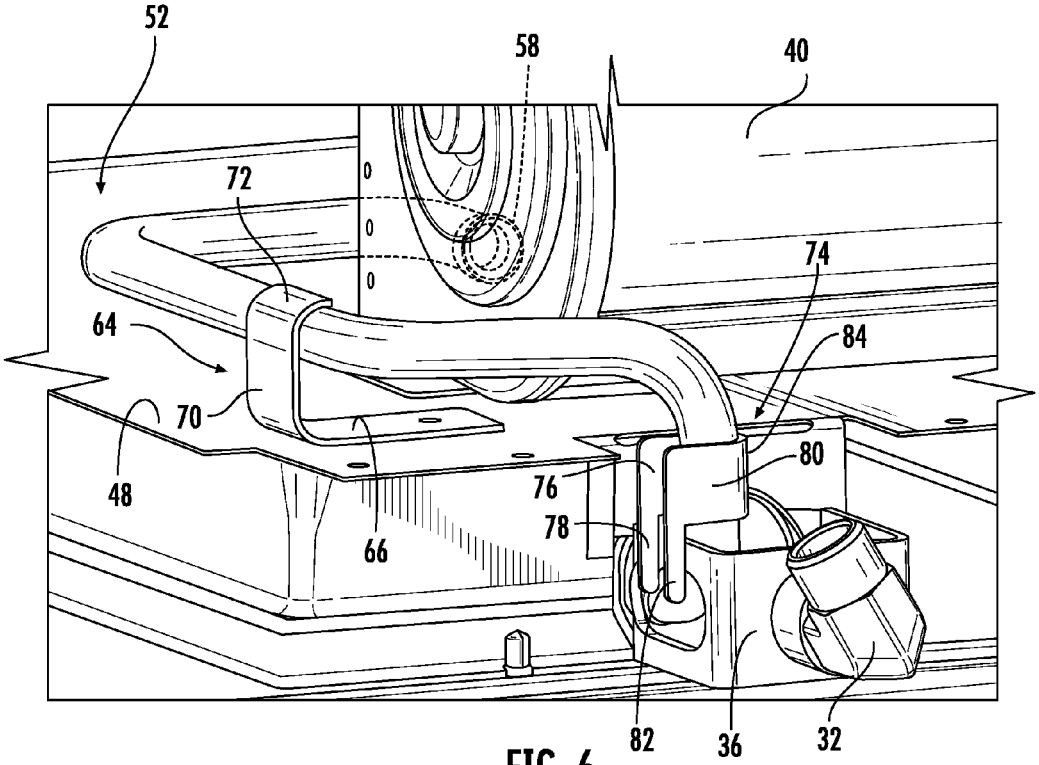
FIG. 6 is another perspective view of the gas and air delivery system illustrated in FIG. 4.

With reference to FIG. 4, FIG. 5 and FIG. 6, the air conduit stabilization apparatus includes a second bracket 74 that acts to stabilize and aim the air conduit 52. The second bracket 74 includes a curved portion 84 that conforms to the air conduit 52 and forms the base of a generally U-shaped bracket portion that engages the air conduit 52 to define engagement surfaces on both the air conduit 52 and the second bracket 64. The second bracket includes two horizontally extending arms 76, 80 extending away from the U-shaped portion and curving into two downwardly projecting arms 78, 82 which engage and fit over a portion of the gas pipe support bracket 36, described in greater detail hereinafter, without fasteners, thereby allowing a more straightforward installation, while placing the gas pipe bracket 36 intermediate the air conduit 52 and the two downwardly projecting arms 78, 82 for stability. The second bracket 74 ensures a proper location of the air tube outlet and helps to minimize the variability and location of the air tube outlet 62 for enhanced performance characteristics. In addition, the second bracket 74 restricts movement and warping of the air conduit in a second direction, different from the first direction, under heating. While both brackets 64, 74 are preferential for stabilizing the air conduit 52, it is contemplated that the second bracket 74 may be used alone to achieve similar benefits.

As seen in FIG. 4, FIG. 5, FIG. 8, and FIG. 9, the air conduit 52 smoothly bends from a downwardly directed portion adjacent the gas pipe bracket 36 through approximately 180° to direct air into the gas mixing pipe 28 for the broil burner 26. An extended gas pipe bracket 36 is cantilevered away from a vertical support panel 50 to support a gas supply pipe 32 and direct an associated gas nozzle 34 at the inlet of the gas mixing pipe 28. The gas pipe bracket 36 also provides support for the second bracket 74 of the air conduit stabilization apparatus as described above and seen in FIG. 4 and FIG. 5.

Figure 9:
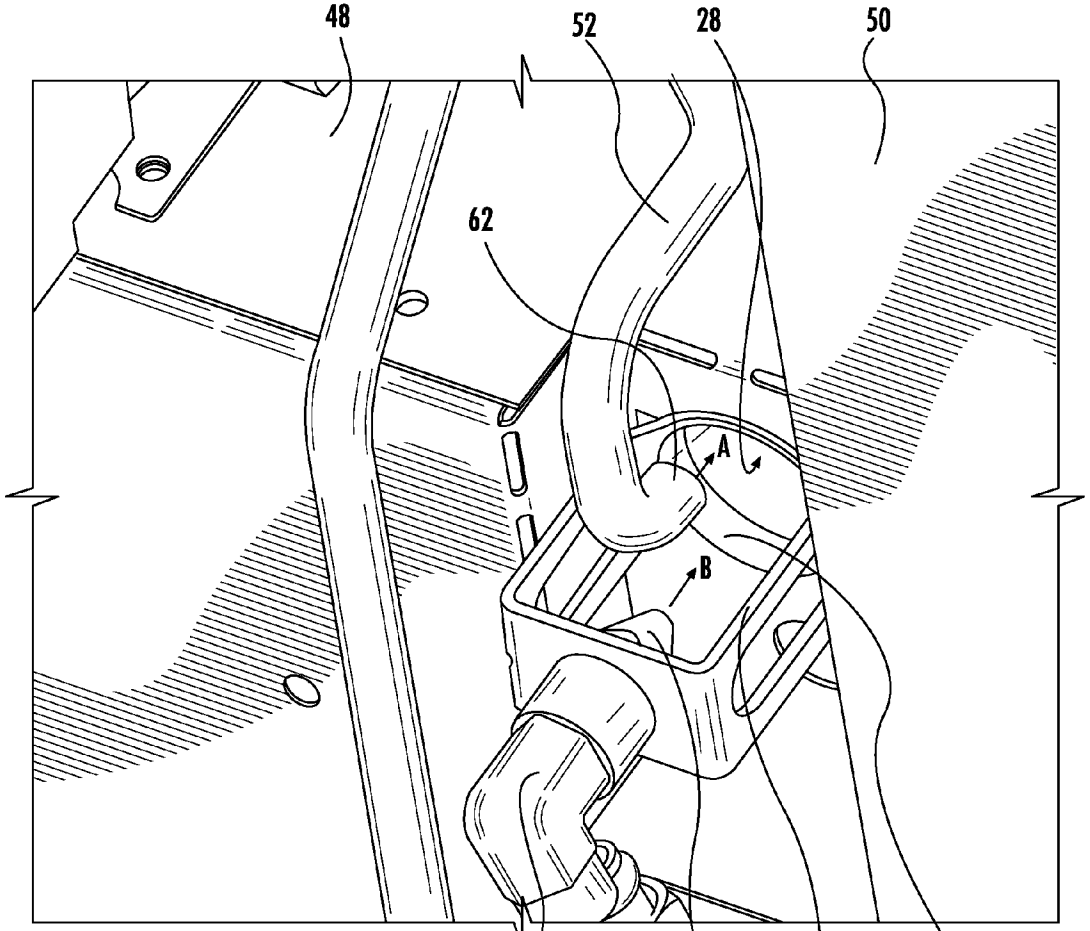
FIG. 9 is a perspective view of the gas and air delivery system illustrated in FIG. 8.

The gas mixing pipe 28 includes a flared portion 30 to facilitate the inlet of air surrounding the gas mixing pipe 28 for combustion. The vertical support panel 50 resides internally of the range body panels. As seen in FIG. 5 and FIG. 9, gas from the gas nozzle 34 is illustrated by Arrow B while supplemental primary air from the air conduit 52 is illustrated at Arrow A. The outlet 62 of the air conduit 52 is placed closely adjacent the inlet to the gas mixing pipe 28 at a position off-center with respect to the gas mixing pipe, a predetermined distance away from the gas mixing pipe and away from the walls forming the gas mixing pipe 28. The air conduit is fixed in this optimized position primarily by the second bracket 74, and secondarily by the first bracket of the air conduit stabilization apparatus for maximum effect of the air delivered by the air conduit 52.

There are several advantages to the air conduit stabilization apparatus. The second bracket 74 locates the air outlet in the correct position inside the burner venturi or gas mixing pipe with reference to the gas mixing pipe bracket. The air conduit stabilization apparatus also keeps the air tube from warping under heated conditions. Overall, the air conduit stabilization apparatus, including the first bracket 64 and the second bracket 74, provides consistency and enhance the overall performances of the air conduit of the present invention.

Figure 8:
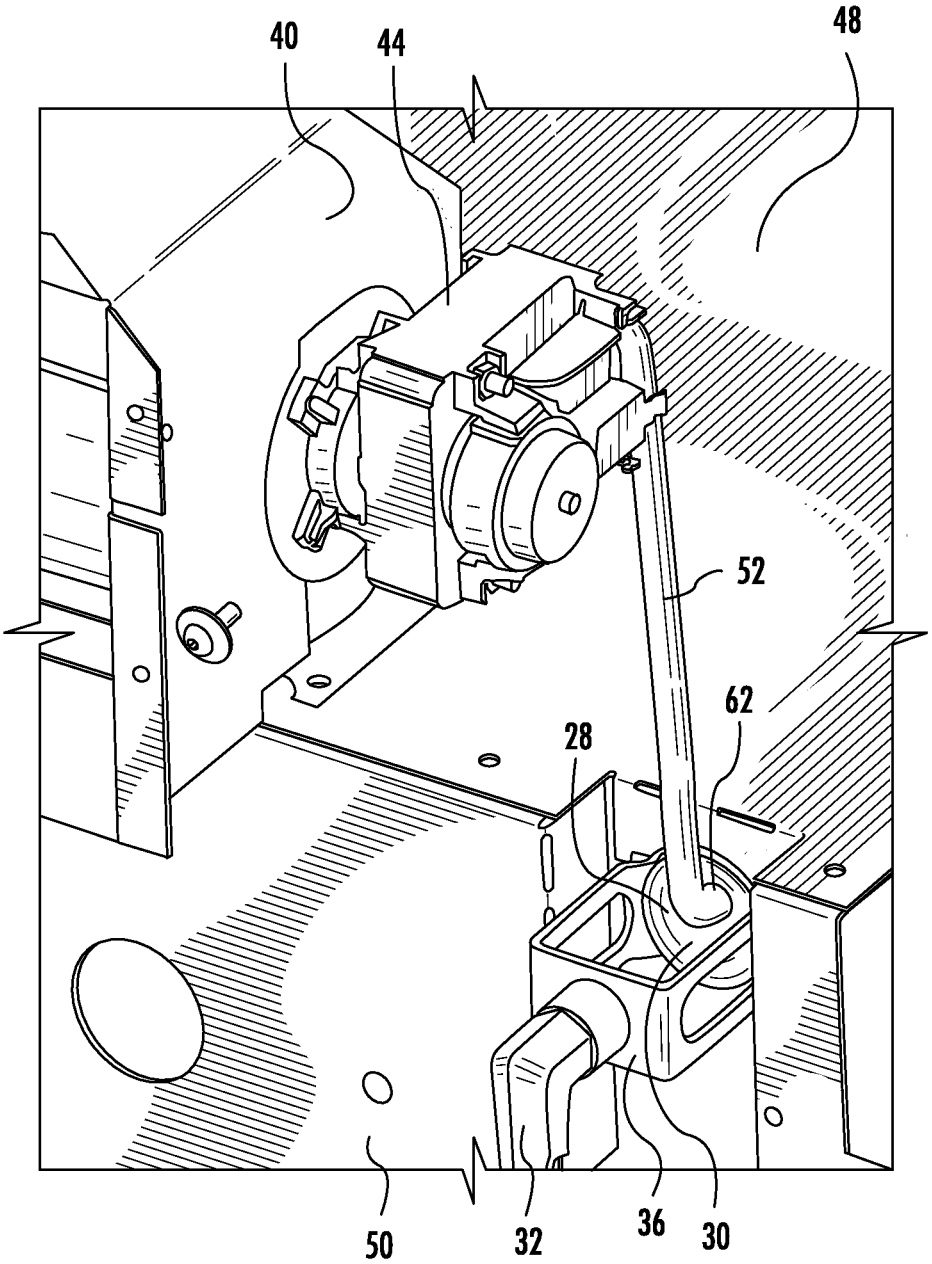
FIG. 8 is a rear view of the fan assembly and air conduit illustrated in FIG. 7.

While FIG. 3, FIG. 4 and FIG. 5 illustrate the preferred embodiment of the present invention using the air conduit stabilization apparatus, it is contemplated that other mounting arrangements can be provided that do not use such brackets. This structure is illustrated in FIG. 7, FIG. 8 and FIG. 9. It is also contemplated that the air conduit stabilization apparatus could be used with a single bracket, i.e. the second bracket 74, although the first bracket 64 helps to stabilize the air conduit 52 against heat damage and provides overall air conduit support.

In operation, as the oven temperature approaches about 300° F. to about 350° F., the fan motor 44 is activated to generate an air stream within the ventilation channel 38 as seen in FIG. 1. This air stream also directs air into the air conduit 52 which routes the air directly into the gas mixing pipe 28 as seen in FIG. 5 where the supplemental primary emitted from the air conduit 52 is mixed with gas and ambient air to enhance the combustion efficiency of the broil burner 26.

By the above, the present invention provides an inexpensive solution to enhancing the efficiency of the broil burner while utilizing existing parts of the range to minimize expense and lower manufacturing costs.

It will therefore be readily understood by those persons skilled in the art that the present invention is susceptible of a broad utility and application. While the present invention is described in all currently foreseeable embodiments, there may be other, unforeseeable embodiments and adaptations of the present invention, as well as variations, modifications and equivalent arrangements, that do not depart from the substance or scope of the present invention. The foregoing disclosure is not intended or to be construed to limit the present invention or otherwise to exclude such other embodiments, adaptations, variations, modifications and equivalent arrangements, the present invention being limited only by the claims appended hereto and the equivalents thereof.

What is claimed is:

1. A home appliance comprising:

an appliance body;

a cooktop on the appliance body;

an oven cavity within the appliance body;

a gas-operable heating element within the oven cavity for heating the oven cavity to a predetermined temperature and including a gas burner and a gas mixing pipe having an inlet open to the oven cavity for intake of gas and primary air for combustion, wherein the gas mixing pipe is open for drawing primary combustion air from inside the appliance body, thereby creating a first primary airstream;

a gas supply pipe for delivering gas to the gas mixing pipe for mixing with the first primary airstream, the gas supply pipe being mounted to a pipe support member for locating and aiming the gas pipe with respect to the gas mixing pipe;

a ventilation channel extending through the appliance body intermediate the cooktop and the oven cavity, the ventilation channel being configured to draw air for ventilation from outside the appliance;

a ventilation fan within the appliance body, the ventilation fan being in fluid communication with the ventilation channel for creating a ventilation airstream within the ventilation channel wherein the ventilation fan is selectively operable for use during times of elevated temperature within the oven cavity; and a supplemental primary air delivery apparatus for use during ventilation fan operation to create a second primary airstream including an air conduit extending between the ventilation channel and the gas mixing pipe, the air conduit having an air conduit inlet in the ventilation airstream and an air conduit outlet closely adjacent the gas mixing pipe to direct air from the ventilation airstream to the gas mixing pipe as the second primary airstream for mixing with the first primary airstream and gas to form a combustible gas-air mixture, and an air conduit stabilization apparatus including at least one bracket configured to overlie and engage the air conduit to thereby prevent movement of the air conduit.

2. A home appliance according to claim 1 wherein the at least one bracket includes a first bracket mounted to the air delivery conduit adjacent the ventilation fan, the first bracket being upstanding from a support surface and includes a curved portion for overlying, engaging and stabilizing the air conduit.

3. A home appliance according to claim 2 wherein the first bracket is configured to restrict movement of the air conduit undergoing heating.

4. A home appliance according to claim 1 wherein at least one bracket includes a second bracket mounted to the air conduit adjacent the gas mixing pipe and engaged with a gas mixing pipe bracket.

5. A home appliance according to claim 4 wherein the second bracket includes a curved portion for overlying and engaging the gas mixing pipe and a downwardly projecting engagement member for engaging the gas mixing pipe bracket.

6. A home appliance according to claim 4 wherein the second bracket includes two downwardly projecting engagement members for engaging the gas mixing pipe bracket.

7. A home appliance according to claim 4 wherein the second bracket supports the gas mixing pipe at a position away from the center of the gas mixing pipe inlet adjacent a gas supply nozzle at the inlet of the gas mixing pipe.

8. A home appliance according to claim 4 wherein the second bracket is configured to restrict movement of the air conduit undergoing heating.

9. A home appliance according to claim 1 wherein the air conduit stabilization apparatus includes a first bracket mounted to the air delivery conduit adjacent the ventilation fan, the first bracket being upstanding from a support surface and includes a curved portion for engaging and restricting movement of the air conduit in a first direction and a second bracket wherein the air conduit stabilization apparatus includes a second bracket mounted to the air conduit adjacent the gas mixing pipe and engaged with the gas mixing pipe bracket for restricting movement of the air conduit in a second direction, wherein the second direction is different than the first direction.

10. A home appliance according to claim 1 wherein the home appliance is a range.

11. A home appliance according to claim 1 wherein the at least one bracket includes a first bracket having a curved portion for overlying, engaging and preventing vertical movement of the air conduit and a second bracket having a curved portion for overlying, engaging and preventing horizontal movement of the air conduit.

12. A home appliance comprising:

a home appliance body;

a cooktop on the home appliance body;

an oven cavity within the home appliance body;

a gas-operable heating element within the oven cavity for heating the oven cavity to a predetermined temperature and including a gas burner and a gas mixing pipe having an inlet open to the oven cavity for intake of gas and primary air for combustion, wherein the gas mixing pipe is open for drawing primary combustion air from outside the oven cavity, thereby creating a first primary airstream;

a gas supply pipe for delivering gas to the gas mixing pipe for mixing with the first primary airstream;

a ventilation channel extending through the home appliance body intermediate the cooktop and the oven cavity, the ventilation channel being configured to draw air for ventilation from outside the home appliance;

a ventilation fan within the home appliance body, the ventilation fan being in fluid communication with the ventilation channel for creating a ventilation airstream within the ventilation channel wherein the ventilation fan is selectively operable for use during times of elevated temperature within the oven cavity; and a supplemental primary air delivery system for use during ventilation fan operation to create a second primary airstream including an air conduit extending between the ventilation channel and the gas mixing pipe, the air conduit having an air conduit inlet in the ventilation airstream and an air conduit outlet closely adjacent the gas mixing pipe to direct air from the ventilation airstream to the gas mixing pipe as the second primary airstream for mixing with the first primary airstream and gas to form a combustible gas-air mixture.

13. A home appliance according to claim 12 wherein the fan is mounted within a fan housing having an air outlet into the ventilation channel and the air conduit is mounted with the air conduit inlet in the air outlet of the fan housing.

14. A home appliance according to claim 12 wherein the air conduit is formed as a tubular member having an air channel extending between the air conduit inlet and the air conduit outlet for free air passage through the air conduit.

15. A home appliance according to claim 14 wherein the air conduit inlet includes a flared end portion.

16. A home appliance according to claim 14 wherein the air channel has a generally circular cross-section and a substantially constant diameter throughout its length.

17. A home appliance according to claim 12 wherein the air conduit outlet is mounted adjacent a gas supply nozzle at the inlet of the gas mixing pipe.

18. A home appliance according to claim 12 wherein the fan is configured to activate at a predetermined temperature to provide air to the ventilation channel and the air conduit.

19. A home appliance according to claim 12 wherein the ventilation fan includes an inlet for drawing air from outside the home appliance for forced delivery of air to the ventilation channel and the air conduit.

20. A home appliance according to claim 12 wherein the home appliance is a range.

* * * * *